United States Patent [19]

Hsieh

[11] 3,967,905

[45] July 6, 1976

[54] SELF-SHARPENING PENCIL

[76] Inventor: Wan Hsing Hsien Hsieh, 21 Fu Teh Road, Kang Chu Li, Pan Chiao Town, Taipei Hsien, China /Taiwan

[22] Filed: May 12, 1975

[21] Appl. No.: 576,458

[52] U.S. Cl. ..... 401/51
[51] Int. Cl.[2] ..... B43K 29/06
[58] Field of Search ..... 401/50, 51; 145/3, 7

[56] References Cited

UNITED STATES PATENTS 2,198,384 4/1940 Purgstall ..... 401/51
2,680,426 6/1954 Kohut ..... 401/51

*Primary Examiner*—Lawrence Charles
*Attorney, Agent, or Firm*—Donald Diamond

[57] ABSTRACT

The head of a self-sharpening pencil is provided with a pair of pivotally disposed, cooperating abraders controlled by a pair of movable members. Means are provided for mechanically driving the graphite core against the abraders whereby the forward end of the graphite core is sharpened to a high degree before it is protruded for writing.

3 Claims, 8 Drawing Figures

SELF-SHARPENING PENCIL

SUMMARY OF THE INVENTION

This invention relates to mechanical pencils and, more particularly, to mechanical pencils provided with a built-in sharpening mechanism for sharpening the forward end of the graphite core before it is protruded from the pencil head for writing.

The sharpening of a conventional pencil is often troublesome work. Although it is customary to install pencil sharpeners in schools and offices to facilitate pencil sharpening, it would be more convenient to provide a mechanical pencil with a built-in sharpening device. A pencil of this type would eliminate the need for school children to carry penknives for pencil sharpening purposes. A significant feature of this invention is that the built-in sharpening mechanism can be manufactured at a low-cost such that the pencil may be discarded after its graphite core has been used up.

In accordance with this invention, there is provided a self-sharpening mechanical pencil comprising, in combination:

- a tubular body, for receiving an elongated graphite core in a central bore thereof;
- a driving mechanism, for axially reciprocating the graphite core and simultaneously rotating the same with respect to the tubular body;
- a sharpening mechanism, contained within the tubular body, for abrading the forward end of the graphite core into a sharpened configuration; and
- cam means, including a pair of movable members, for engaging the sharpening mechanism with the graphite core in one position of the mechanical pencil, and for disengaging the sharpening mechanism from the graphite core in another position of the mechanical pencil.

The tubular body includes a head portion and a body portion. The sharpening mechanism advantageously comprises a pair of abraders pivotally disposed in the head portion and having cooperating inner surfaces for defining a sharpening core. The abraders are controlled by movable members disposed in channels in the head portion adjacent to the outer surfaces of the abraders. The channels become increasing shallower towards the tip of the pencil such that the abraders will diverge when the movable members move away from the tip, and that the abraders will converge to form a sharpening core when the movable members move toward the tip.

In one embodiment of this invention, the mechanical pencil is a directly driven model in which the head portion is rotatably secured to the body portion and in which the graphite core is driven by driving member disposed within and secured to the head portion rearwardly of the abraders. The driving member is provided with a central threaded aperture for threadedly engaging mating threads on the outer surface of the graphite core. The cross-section of the graphite core is in the shape of a segmented circle and the graphite core is disposed within a matching bore in the body portion such that the turning of the head portion will move the graphite core forwards or backwards, depending on the direction of rotation.

In a second embodiment of this invention, the mechanical pencil is an indirectly driven model having integral head and body portions with the inner surface of the body portion being threaded throughout its length. A graphite core is disposed within the tubular body in spaced relationship to the body portion. A driving member is attached to the upper end of the graphite core. The driving member has two opposing flattened surfaces and two opposing arcuate surfaces with the arcuate surfaces being threaded for threadedly engaging mating threads on the inner surface of the body portion. The flattened surfaces of the driving member are in slidable contact with a pair of rotatable rail strips disposed within and extending the length of the body portion. The rail strips are connected at their outer end by a turnable member. Rotation of the rail strips will rotate the driving member and, since the arcuate surfaces of the driving member are in threaded engagement with the inner surface of the body portion, such rotation will move the graphite core forwards or backwards, depending upon the direction of turning, and, at the same time, will impart a rotary motion to the graphite core with respect to the abraders in the head portion to effect sharpening of the forward end of the core.

DETAILED DESCRIPTION

Figure 4:
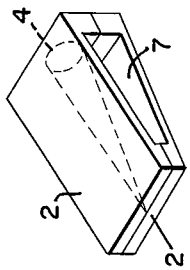
FIG. 4 is a perspective view of two abraders closing up to form a sharpening cone.
Figure 5:
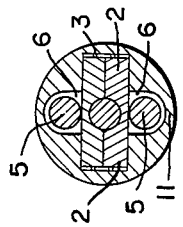
FIG. 5 is a cross-section taken along A—A in FIG. 2.
Figure 1:
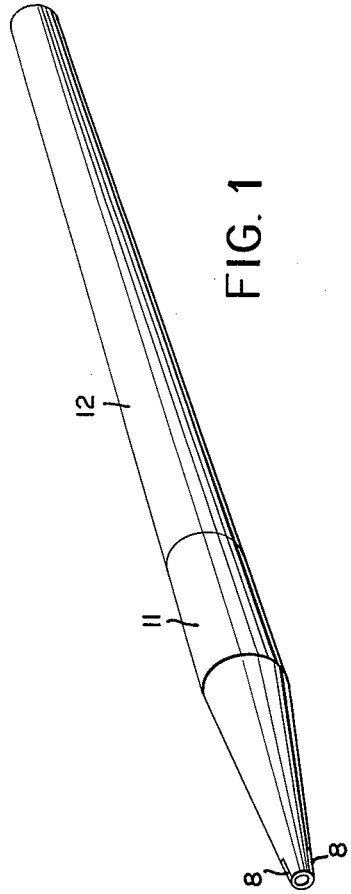
FIG. 1 shows the external appearance of the directly driven self-sharpening pencil.
Figure 2:
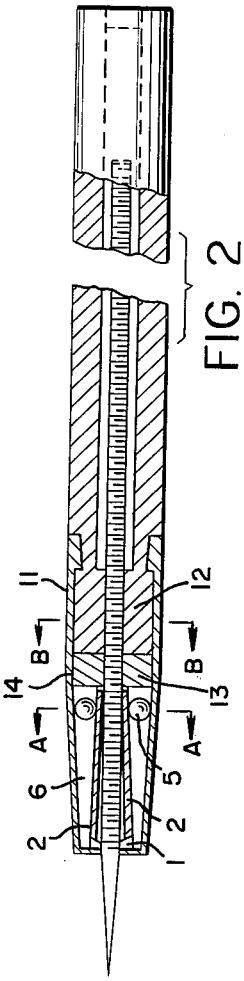
FIG. 2 is a longitudinal cross-section of the directly driven self-sharpening pencil.
Figure 3:
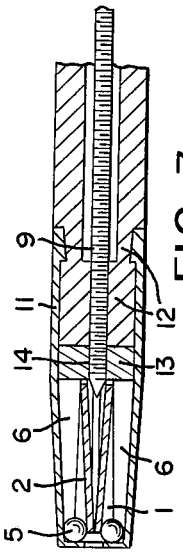
FIG. 3 shows the shape and position of abraders and movable balls in the sharpening mode.

The sharpening mechanism described below is common to both the directly driven self-sharpening pencil and the indirectly driven self-sharpening pencil. Referring to FIG. 2 and FIG. 3, inside a cavity 1 in the head of the pencil, two abraders 2, with the shape as shown in FIG. 4, are pivoted at their thickened ends with pivots 3 to the wall of the cavity, leaving their tapering ends free. The abraders are arranged with their abrading surfaces facing each other such that when they are closed up together their abrading surfaces will form a sharpening core 4. As the pencil is to be discarded after its graphite core has been used up, the abrader may be made with glass powder adhered to a base attached to a plastic body. The closing and parting of the abraders is controlled by the position of a pair of movable metal balls 5 disposed in opposing U-shaped channels formed in the wall of the cavity adjacent to the outer surfaces of the abraders. The channels are increasingly shallower toward the tip of the pencil such that when the balls roll toward the tip, the shallower channels will force them to press against the tapering ends of the abraders, closing them up to form a sharpening cone. In sharpening the graphite core, the pencil is held with its tip pointing upwards to let the balls roll rearwardly to the position as shown in FIG. 2, to release any pressure of the abraders on the graphite core. The graphite core may now be retracted inwards by turning the driving mechanism backwards. After the graphite core has been retracted, invert the pencil so that its tip points downwards. Now the balls 5 will roll to the position as shown in FIG. 3, pressing the abraders to form a sharpening cone. The graphite core is then driven forward so that it rotationally advances against the sharpening cone and becomes sharpened. Tilt the pencil a little to let the graphite dust fall through an opening 7 between the abraders and through a hole 8 near the tip. After the removal of graphite dust, invert the pencil again so that its tip points upwards. The balls roll to the position as shown in FIG. 2 permitting the abraders to part from each other. Now the graphite core is driven forwards until a suitable length is protruded for writing.

Directly driven model and indirectly driven model differ in their driving mechanism and in the shape of their graphite cores.

Figure 6:
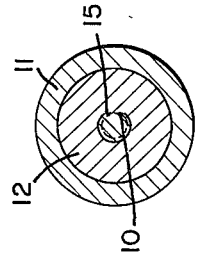
FIG. 6 is a cross-section taken along B—B in FIG. 2.

For the directly driven model (refer to FIG. 3 and FIG. 6), a screw thread 9 and a flattened portion 10 persist throughout the whole length of the graphite core. Thus, the cross-section of the graphite core will be a circle with a minor segment removed. The tubular body of the pencil of this model is composed of two portions, a head portion 11 and a body portion 12, that are turnably joined together by means of a flanged joint. Inside the head portion and behind the cavity 1, a driving piece 13 is rigidly attached to the head portion 11. The driving piece is provided with a central threaded aperture 14 for threadedly engaging mating threads 9 on the outer surface of the graphite core. The bore of the body portion 12 is provided with a flattened part 15 to engage the flattened portion 10 of the graphite core. When the head portion 11 is rotated, the driving collar 13, swaged thereinto, will turn together with it. Since the graphite core is prevented from rotating with respect to the body portion 12 as a result of the interaction of the flattened bore segment 15 with the flattened portion 10 of the graphite core, and since the bore of the driving collar is provided with an internal thread matching the threaded outer surface of the graphite core, the rotation of the head portion 11 will axially move the graphite core either forwards or backwards, depending on the direction of rotation. Thus, it is possible to advance and to withdraw the graphite core and at the same time provide the graphite core with a turning motion relative to the abraders 2 for sharpening.

Figure 8:
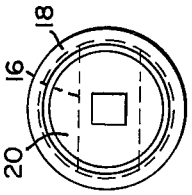
FIG. 8 is a cross-section along C—C viewed from the right in FIG. 7 with the turnable disc removed.
Figure 7:
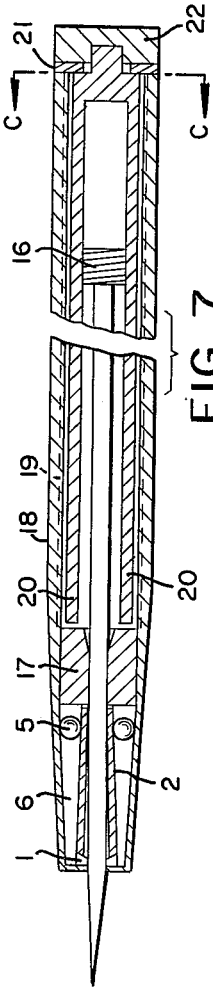
FIG. 7 is a longitudinal cross-section of the indirectly driven self-sharpening pencil.

For the indirectly driven model (refer to FIG. 7), the graphite core is a smooth rod without thread or flattened portion. A driving piece 16 is attached to the upper end of the graphite core. The shape of the driving piece 16 is illustrated in FIG. 8. It has two opposing arcuate surfaces and two opposing flattened surfaces. The arcuate surfaces are threaded whereas the flattened surfaces are smooth. A centrally apertured guide 17 is fixed in the head portion rearwardly of the abraders. The inner wall of the body portion 18 is provided with screw thread 19 throughout its whole length. This internal thread engages the external thread of the driving piece 16. Tines 20 form a pair of rotatable rail strips that match with the flattened surfaces of the driving piece 16. The two rail strips join together just as two arms of a fork do, as shown in FIG. 7. The conjoint end of the rail strips is first shaped into a round peg on which a washer 21 is mounted, and further from there it is shaped into a smaller square peg on which a turnable disc 22 with a square hole is mounted. The driving piece 16 is mounted between the rail strips 20 with its smooth flattened surfaces slidably in contact with the strips. When the turnable disc 22 is turned, the rail strips 20 and the driving piece 16 rotate together. Since the screw thread on the arcuate surfaces of the driving piece is in engagement with the thread 19 on the inner wall of the body portion 18, the rotation will cause the driving piece to slidably advance, or retreat, between the rail strips, As the graphite core is rigidly connected to the driving piece, it is possible to advance and withdraw the graphite core and at the same time provide it with a turning motion relative to the abraders.

It is understood that changes in details such as the shape and size of pencil body, abraders, driving piece and graphite core may be made without departing from the spirit and scope of this invention.

That which is claimed is:

1. A self-sharpening mechanical pencil comprising, in combination:

a tubular body, for receiving an elongated graphite core in a central bore thereof;

driving means, for axially reciprocating said graphite core and simultaneously rotating the same;

a sharpening mechanism, contained within the tubular body, for abrading the forward end of the graphite core into a sharpened configuration, said sharpening mechanism including a pair of pivotally disposed abraders having abrading surfaces which form a sharpening core upon convergence of the abraders; and cam means for engaging said abraders with the graphite core in one position of the mechanical pencil, and for disengaging said abraders from the graphite core in another position of the mechanical pencil, said cam means comprising channels in the inner wall of the tubular body adjacent to the outer surface of the abraders in combination with movable members disposed therein, said channels being increasingly shallower toward the tip of the mechanical pencil whereby the displacement of said movable members towards said tip causes said abraders to pivotally converge to form a sharpening cone.

2. A mechanical pencil according to claim 1 wherein said tubular body includes a head portion rotatably secured to a body portion with said sharpening mechanism being disposed in said head portion and said driving means being a driving member disposed in and secured to said head portion rearwardly of said sharpening mechanism, said driving member having a central threaded aperture, said body portion having a smooth bore whose cross-section is in the shape of a circle with a segment removed such that when a graphite core threaded throughout its length and having a cross-section corresponding to that of said bore is installed in said mechanical pencil, the rotation of said head portion will move the graphite core forwards or backwards, depending on the direction of said rotation.

3. A mechanical pencil according to claim 1 wherein said tubular body includes integral head and body portions with the inner surface of the body portion being threaded throughout its length and said sharpening mechanism being disposed in said head portion, a graphite core disposed in said tubular body in spaced relationship to said body portion, and the driving means for said graphite core including a driving member secured to the upper end of said graphite core, said driving member having two opposing flattened surfaces and two opposing arcuate surfaces with the arcuate surfaces being threaded for threadedly engaging mating threads on the inner surface of the body portion, said flattened surfaces of said driving member being in slidable contact with a pair of rotatable rail strips disposed within and extending the length of said body portion and said rail strips being joined at their outer end whereby the rotation of said rail strips will move the graphite core forwards or backwards, depending on the direction of said rotation.

* * * * *